US005617699A

United States Patent [19]

Thompson, Jr.

[11] Patent Number: 5,617,699

[45] Date of Patent: Apr. 8, 1997

[54] SPACER FOR AN INSULATING UNIT HAVING IMPROVED RESISTANCE TO TORSIONAL TWIST

[75] Inventor: Albert E. Thompson, Jr., New Kensington, Pa.

[73] Assignee: PPG Industries, Inc., Pittsburgh, Pa.

[21] Appl. No.: 529,180

[22] Filed: Sep. 15, 1995

Related U.S. Application Data

[63] Continuation-in-part of Ser. No. 326,565, Oct. 20, 1994, Pat. No. 5,553,440.

[51] Int. Cl.[6] ..... E04C 2/54

[52] U.S. Cl. ..... 52/786.13; 52/786.1; 52/786.11; 52/800.14

[58] Field of Search ..... 52/786.1, 786.11, 52/786.13, 172, 308, 800.14

[56] References Cited

U.S. PATENT DOCUMENTS

| | | |
|---|---|---|
| 2,525,717 | 10/1950 | Ottenheimer . |
| 2,575,854 | 11/1951 | Verhagen . |
| 2,688,824 | 9/1954 | Badger et al. . |
| 2,861,398 | 11/1958 | Woods . |
| 2,877,516 | 3/1959 | Bobel . |
| 3,024,880 | 3/1962 | Burmeister . |
| 3,045,297 | 7/1962 | Ljungdahl . |
| 3,837,129 | 9/1974 | Losell . |
| 3,919,023 | 11/1975 | Bowser et al. . |
| 3,919,821 | 11/1975 | Goetz . |
| 4,149,348 | 4/1979 | Pyzewski . |
| 4,170,460 | 10/1979 | Donley . |
| 4,239,816 | 12/1980 | Breininger et al. . |
| 4,335,166 | 6/1982 | Lizardo et al. . |
| 4,368,226 | 1/1983 | Mucaria . |
| 4,411,115 | 10/1983 | Marzouki et al. . |
| 4,610,711 | 9/1986 | Matesa et al. . |
| 4,719,127 | 1/1988 | Greenberg . |
| 4,792,536 | 12/1988 | Pecoraro et al. . |
| 4,806,220 | 2/1989 | Finley . |
| 4,853,256 | 8/1989 | Obringer et al. . |
| 4,853,257 | 8/1989 | Henery . |
| 4,873,206 | 10/1989 | Jones . |
| 5,007,217 | 4/1991 | Glover et al. . |
| 5,030,593 | 7/1991 | Heithoff . |
| 5,177,916 | 1/1993 | Misera et al. . |
| 5,313,762 | 5/1994 | Guillemet . |
| 5,436,040 | 7/1995 | Lafond . |

FOREIGN PATENT DOCUMENTS

| | | |
|---|---|---|
| 0475213 | 3/1992 | European Pat. Off. . |
| 90304456 | 3/1992 | European Pat. Off. . |

*Primary Examiner*—Carl D. Friedman
*Assistant Examiner*—Aimee E. McTigue
*Attorney, Agent, or Firm*—Donald C. Lepiane

[57] ABSTRACT

A spacer stock and/or spacer frame having a pair of spaced outer legs joined by a base has a strengthening member integral with the base or an insert between the legs to reduce the degree of torsional twist of the spacer stock and/or spacer frame. In one embodiment during the forming of the spacer stock a "T" shaped member is formed integral with the base to reduce the degree of torsional twist.

23 Claims, 5 Drawing Sheets

SPACER FOR AN INSULATING UNIT HAVING IMPROVED RESISTANCE TO TORSIONAL TWIST

RELATED APPLICATION

This application is a continuation-in-part application of U.S. patent application Ser. No. 08/326,565 filed on Oct. 20, 1994, now U.S. Pat. No. 5,553,440 in the names of Mark L. Bulger and Albert E. Thompson, Jr. for Multi-Sheet Glazing Unit and Method of Making Same.

FIELD OF THE INVENTION

This invention relates to a spacer stock and/or spacer frame for use in the manufacture of multi-sheet glazing unit, and, in particular to a spacer stock and/or a spacer frame subsequently formed therefrom having improved resistance to torsional twist.

BACKGROUND OF THE INVENTION

European Patent Application Publication Number 0 475 213 A1 published 18.03.92 Bulletin 92/12 (hereinafter "EP Application") based on U.S. patent applications Ser. Nos. 578,697; 578,696 and 686,956 filed Sep. 4, 1990; Sep. 4, 1990, and Apr. 18, 1991, respectively discloses a thermal insulating glazing unit having an edge assembly having low thermal conductivity and a method of making same. In general, the EP Application teaches a thermal insulating glazing unit having a pair of glass sheets about and sealed to an edge assembly to provide a sealed compartment between the sheets. The edge assembly includes a spacer frame having a generally U shaped cross section having a sealant on each of the outer surfaces of the upright legs, and optionally on the outer surface of the base of the spacer frame and an adhesive bead having desiccant therein adhered to inner surface of the base of the spacer frame.

U.S. Pat. No. 5,177,916 issuing on U.S. patent application Ser. No. 578,697 filed Sep. 4, 1990, discloses a flat metal substrate that may be formed into spacer stock and thereafter formed into a spacer frame for use in the manufacture of an insulating unit of the type disclosed in the EP Application. The spacer stock disclosed in U.S. Pat. No. 5,177,916 has a pair of outer legs spaced from one another and joined to one another by a base.

European Patent Application No. 90 304 456.8 discloses an insulating unit having a pair of glass sheets separated by and secured to a spacer frame having a "W" shape cross section.

Although the design of the spacer stock and/or spacer frame disclosed in the EP Application, U.S. Pat. No. 5,177,916 and European Patent Application No. 90 304 456.8 is acceptable, it has limitations. More particularly, the spacer stock has incremental torsional twist because the legs of the spacer stock and/or spacer frame are only interconnected by the base. As can be appreciated, as the length of the spacer stock or sides of the spacer frame between adjacent corners increases the degree of twist of the spacer stock between the ends or the sides of the spacer frame between adjacent corners increases.

As can be appreciated by those skilled in the art of making multi-sheet glazing units, it would be advantageous to provide a spacer stock design that minimizes if not eliminates torsional twist of the spacer stock and/or of the subsequently formed spacer frame for ease of handling the spacer stock/spacer frame during fabrication of a multi-sheet glazing unit.

SUMMARY OF THE INVENTION

This invention relates to a spacer stock and/or spacer frame for use in the manufacture of insulating units. The spacer stock and/or spacer frame has a pair of outer legs spaced from and joined to one another by a base. The base is provided with a strengthening member to reduce the degree of rotational twist between the ends of the spacer stock and/or the side between adjacent corners of the spacer frame. The strengthening member may be an insert, but preferably is integral with the spacer stock and/or spacer frame and has a vertical extension extending between the outer legs and optionally a horizontal member to provide the member with a "T" shaped cross section when considered alone and when considered with the base of spacer stock and/or spacer frame has an "I" shaped cross section. The member to reduce torsional twist when an insert is secured between the outer legs of the spacer stock and/or spacer frame.

Further, the invention relates to a glazing unit having a pair of sheets spaced from each other by the spacer frame of the instant invention and secured to the outer legs of the spacer frame.

Still further, the invention relates to a method of forming the spacer stock and/or spacer frame of the instant invention and/or of making a multiple glazed unit using the spacer stock and/or spacer frame of the instant invention.

BRIEF DESCRIPTION OF THE INVENTION

The various embodiments of the spacer stock and/or spacer frame of the instant invention will be discussed in the construction of a glazing unit having a low thermal conducting edge determined as disclosed in the EP Application which disclosure is hereby incorporated by reference. As will be appreciated, the instant invention is not limited to a multi-sheet glazing unit that is thermally insulating and/or has a low thermal conductive edge, and that the embodiments of the present invention may be used with a multi-sheet glazing unit regardless of its thermal insulating value. In the following discussion unless otherwise indicated like numerals refer to like elements.

Further "and/or" and "/" are used interchangeably in the following discussion. Still further, discussion of torsional twist of the spacer stock unless indicated otherwise is applicable to side of the spacer frame between adjacent corners and vice versa.

Figure 1:
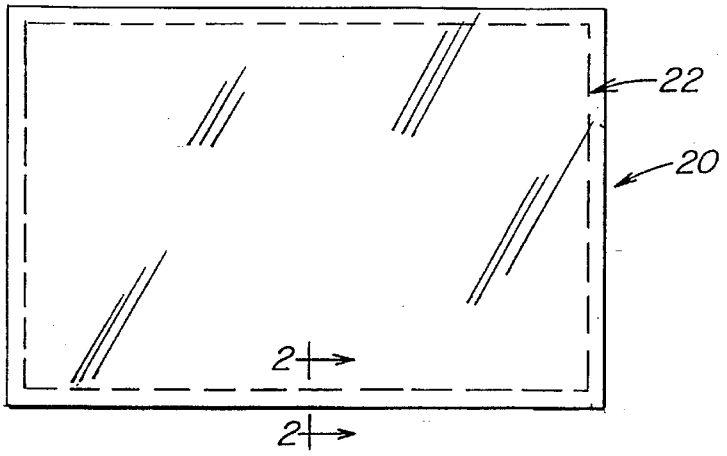
FIG. 1 is a front elevated view of a multi-sheet glazing unit incorporating features of the invention.
Figure 2:
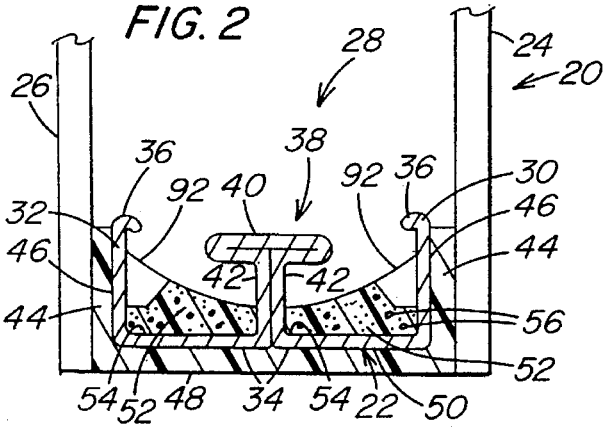
FIG. 2 is the view taken along lines 2—2 of FIG. 1 illustrating an embodiment of a spacer frame of the invention.

FIG. 1 illustrates an insulating unit 20, and FIG. 2 illustrates a cross-sectional view of the insulating unit 20 having spacer frame 22 incorporating features of the invention. With specific reference to FIG. 2, the unit 20 includes the spacer frame 22 between and secured to a pair of outer sheets 24 and 26 to provide a compartment 28 between the sheets 24 and 26. Preferably but not limiting to the invention, the compartment 28 is sealed against the egress and ingress of gas e.g. air, moisture and/or dust (hereinafter individually and collectively referred to as "environmental air") in a manner to be discussed below.

In the following discussion the sheets 24 and 26 are glass sheets; however, as will become apparent, the sheets may be made of any material e.g. glass, plastic, metal and/or wood, and the selection of the materials is not limiting to the invention. Further, the sheets may be all of the same material or the sheets may be of different materials, and one sheet may be a monolithic sheet and the other sheet a laminated sheet e.g. made of one or more monolithic sheets laminated together in any usual manner. Still further, one or more of the surfaces of one or more of the sheets may be coated e.g. glass or plastic transparent sheets may have an opaque coating of the type used in making spandrels or, an environmental coating to selectively pass predetermined wavelength ranges of light. U.S. Pat. Nos. 4,610,711; 4,806,220; 4,853,256; 4,170,460; 4,239,816 and 4,719,127 hereby incorporated by reference disclose coated sheets that may be used in the practice of the invention; however, as can be appreciated, the instant invention is not limited thereto. In the practice of the invention, but not limiting thereto, one or more of the glass sheets may be coated and/or uncoated colored sheets for example, but not limiting to the invention, colored sheets of the type disclosed in U.S. Pat. Nos. 4,873,206; 4,792,536; 5,030,593 and 5,240,886 which disclosures are hereby incorporated by reference.

The outer sheets 24 and 26 preferably have the same peripheral configuration and dimensions; however, as can be appreciated, one outer sheet may be larger than the other outer sheet, and one of the sheets may have different peripheral configuration than the other sheet.

With continued reference to FIG. 2, the spacer frame 22 includes a pair of spaced outer legs 30 and 32 secured to a base 34. The outer legs each having extension 36 are preferably spaced from one another and only contact one another by way of the base 34 to provide the unit with a low thermal edge. The base 34 is provided with an upright strengthening member or torsional twist resistance member 38 as viewed in FIG. 2 incorporating features of the invention. The upright portion 38 in the preferred embodiment of the invention includes a horizontal member 40 joined to a vertical members 42 as viewed in FIG. 2 to provide the torsional twist resistance member 38 with a "T" shape cross section when viewed alone and with an "I" shape cross section when viewed joined to the base 34. The resistance member 38 is discussed in more detail below. Although the vertical members 42 are shown as two members in FIG. 2, as can be appreciated it can be one member, and the invention is not limited thereto.

A layer 44 of a moisture impervious sealant e.g. an adhesive-sealant material of the type used in the art of making multi-sheet glazing units having sealed compartments between the sheets is provided on outer surface 46 of the outer legs 30 and 32 of the spacer frame 22 to secure the outer sheets 24 and 26 to outer legs 30 and 32 respectively of the spacer frame 22 to seal the compartment 28 against movement of environmental air into and out of the compartment. With continued reference to FIG. 2, and not limiting to the invention, a layer 48 of a sealant or adhesive-sealant may be provided over outer surface 50 of the base 34 of the spacer frame 22. The layer 48 may be a similar material as the material of the layer 44; however, it is preferred that the material of the layer 48 be non-tacky so that the units when stored or shipped on edge do not stick to the supporting surface. Further, units having the layer 48, have the spacer frame 22 preferably below the peripheral edges of the outer sheets 24 and 26 to provide a channel to receive the layer 48 as shown in FIG. 2. As can now be appreciated by those skilled in the art of multi-sheet glazing units; the layer 48 may be eliminated by setting the outer surface 50 of the base 34 flush with the peripheral edges (see FIG. 10), or extending beyond the peripheral edges, of the sheets.

The spacer frame of the instant invention may be made of any material e.g. wood, plastic, cardboard, compressed paper, metal e.g. stainless steel, galvanized iron, tin coated steel, or aluminum having any cross sectional configuration to provide the spacer stock and/or spacer frame with resistance to torsional twist. Preferably in the practice of the invention the spacer stock/spacer frame is made of metal.

With continued reference to FIG. 2, beads 52 are provided on the inner surface portions 54 of the base 34 of the spacer frame 22. The beads 52 may be made of any material and preferably are a moisture pervious material having a desiccant 56 to adsorb moisture in the compartment 28. The beads 52 may be of any material known in the art of multi-sheet insulating glazing units. Using a flowable material provides for ease of automating the positioning of the beads 52 on the base and/or fabrication of the units. Materials that may be used in the practice of the invention for the beads are materials that are of the type taught in the EP Application, and in U.S. patent application Ser. No. 08/102,596. The disclosure of U.S. patent application Ser. No. 08/102,596 is hereby incorporated by reference. As can be appreciated, one bead may be used instead of the two beads 52 as shown in FIG. 2.

The spacer frame of the instant invention having resistance to torsional twist may be formed to have continuous corners e.g. of the type disclosed in the EP Application and in U.S. Pat. No. 5,177,916, or may be formed by joining ends of spacer sections by corner keys or welding as is known in the art of making multi-sheet insulating glazing units. As used herein, a continuous corner is a corner having the base of the spacer frame continuous around the corners and/or portions of the legs at the corners continuous as contrasted to joining ends of spacer sections e.g. by corner keys or by welding.

The spacer frame of the instant invention may be made of any material and configuration provided the spacer stock and spacer frame has resistance to torsional twist. Preferably, but not limiting to the invention, the spacer frame has structural stability to maintain the outer glass sheets 24 and 26 in spaced relationship to one another when biasing forces are applied to secure the unit 20 in a sash or a curtainwall system. Although the spacer frame of the instant invention may be made of any material, it is preferred that the spacer frame be made of metal and it is preferred that the spacer frame have low thermal conductivity so that the edge assembly of the unit which includes the spacer frame 22, the layers 44, the layer 48 (when present) and beads 52 have a low thermal conductivity or high RES-value as disclosed in the EP Application.

Further, as can be appreciated, the spacer frame 22 is preferably made of a material that is moisture and/or gas impervious such as but not limited to metal e.g. stainless steel, but includes halogenated polymeric material and/or spacers made of a gas pervious material and covered with an impervious film e.g. metal or polyvinylidene chloride film.

In regards to the edge assembly having a low thermal conductivity, spacer frames made of aluminum conduct heat better than spacer frames made of metal coated steels e.g. galvanized or tin plated steel, spacer frames made of metal coated carbon steels conduct heat better than spacer frames made of stainless steels, and spacer frames made of stainless steels conduct heat better than spacer frames made of plastics. Plastic provides better spacer frames from the standpoint of low thermal conductivity; however, metal is preferred for spacer frames because in many instances it is easier to shape and lends itself more easily to automation than plastic materials.

In the discussion of the instant invention and in the claims, RES-value is defined as the resistance to heat flow of the edge assembly per unit length of perimeter.

For a low thermal conducting edge of a multi-sheet unit of the instant invention, a RES-value of at least about 10° is acceptable, a value of at least about 50 is preferred and a RES-value of at least about 100 more preferred.

Units filled with an insulating gas e.g. Argon preferably have the adhesive-sealant layer 44 and the layer 48 of a moisture and/or gas impervious material to maintain the insulating gas in the compartment 28. It is recommended that the adhesive-sealant layer 44 be thin and long to reduce the diffusion of the insulating gas out of the compartment of the unit or the environmental gas moving into the compartment of the unit. The material for the layer 44 preferably has a moisture permeability of less than 20 gm mm/$M^2$ day, and more preferably less than 5 gm mm/$M^2$ day, determined using the procedure of ASTM F 372-73. The invention may be practiced with the adhesive-sealant layer 44 having a thickness of about 0.005 inch (0.013 centimeter (hereinafter "cm")) to about 0.125 inch (0.32 cm), preferably about 0.010 inch (0.025 cm) to about 0.020 inch (0.050 cm) and more preferably about 0.015 inch (0.38 cm), and the layer 44 having a length or height as viewed in FIG. 2 of about 0.010 inch (0.025 cm) to about 0.50 inch (1.27 cm), preferably about 0.125 inch (0.32 cm) to about 0.50 inch (1.27 cm) and more preferably about 0.200 inch (0.50 cm).

Adhesive-sealants that may be used in the practice of the invention include but are not limited to butyls, silicones, polyurethane adhesives, and preferably butyls and butyl hot melts such as H. B. Fuller 1191, H. B. Fuller 1081A and PPG Industries, Inc. 4442 butyl sealant.

The degree of torsional twist is a term used to describe twist of the spacer stock or sides between adjacent corners of the spacer frame. By way of illustration, spacer stock having a 2 inch (5.08 cm) length may have one radian of twist. For each additional two inch length of spacer stock the spacer stock between the ends will have an incremental one radian of twist. Therefore for spacer stock 10 inches (25.4 cm) in length the degree of torsional twist is 5 radians.

The height of the vertical member 42 and the width of the horizontal member 40 are not limiting to the invention and principally depend on the length of the extensions, the length of the spacer stock, the length of the sides between corners of the spacer frame, the spaced distance of the upright legs, and the thickness of the spacer stock. Increasing the length of the extensions 36 (FIG. 2) (or extensions 58 in FIG. 11), the degree of torsional twist of the spacer stock decreases and vice versa; increasing the length of the spacer stock or sides of the spacer frame between adjacent corners, while keeping all the other variables constant, increases the degree of torsional twist of the spacer stock between its ends or sides of the spacer frame between adjacent corners and vice versa; increasing the spaced distance of the upright legs while keeping the remaining variables constant decreases the degree of torsional twist and vice versa; increasing the thickness of the spacer stock while keeping all the other variables constant decreases the degree of torsional twist and vice versa; increasing the shear modulus of the material of the spacer stock while keeping the remaining variables constant decreases the degree of torsional twist and vice versa; increasing the height of the legs 30 and 32 of the spacer stock while keeping the remaining variables constant decreases the degree of torsional twist and vice versa. As can be appreciated, the above discussion is not limiting to the invention and is present to appreciate the interaction of the parts of the spacer stock as they relate to the degree of torsional twist.

In the practice of the invention it is recommended for esthetics that the overall height of the member 38 be less than the height of the legs 30 or 32. In the event an overall height greater than the height of the legs 30 or 32 is required, two spaced upright members may be used. In general, spacer stock and spacer frame made of 304 stainless steel and having vertical legs 42 each having a height of 0.1 inch (0.254 cm) and horizontal member 40 having a width of 0.254 inch (0.64 cm) will provide 0.166 T radians/inch of torsional twist for each inch of spacer stock, where T is the applied torque in pound-inch. By way of example but not limiting to the invention, for 1040 steel the twist is 0.145 T radians per inch. In the practice of the invention, for spacer stock made of 304 stainless steel, an end to end torsional twist of less than 0.15 radian per inch (8.6 degrees per inch) is acceptable, 0.075 radians per inch (4.3 degrees per inch) is preferred and no twist or zero twist is most preferred. For stainless steel, a maximum twist of 0.23 radians per inch is acceptable, 0.115 radians per inch is preferred and zero twist is most preferred. As can be appreciated the above examples are presented for purposes of illustration and are not limiting to the invention. Acceptable twist for other metals and non metals can be determined by one skilled in the art from the above information.

In the practice of the invention, the torsional twist should not be of a magnitude to permanently deform the spacer stock and or spacer frame by allowing shear stress to exceed the yield point of the material of the spacer stock and/or spacer frame.

The discussion will now be directed to forming spacer stock and/or spacer frame incorporating features of the invention.

Figure 3:
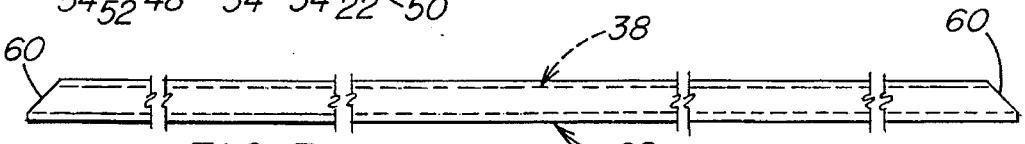
FIG. 3 is a side elevated view of one embodiment of spacer stock incorporating features of the invention.

With reference to FIG. 3, one technique to form a spacer frame of the instant invention is to join ends 60 of sections or spacer stock 62 (only one section shown in FIG. 3) in any convenient manner e.g. the ends 60 of the spacer stock 62 may be welded together, joined by corner keys or held together by an adhesive.

The discussion will now be directed to forming a spacer frame using the sections or spacer stock 62 incorporating features of the invention. The sections 62 have their ends 60 angled or mitered so that when the ends 60 of the sections 62 are joined together a closed spacer frame is formed e.g. the ends 60 have a 45° angle for forming a parallelepiped spacer frame, for a pentagonal shaped spacer frame the ends 60 of the sections 62 have a 54° angle.

Figure 5:
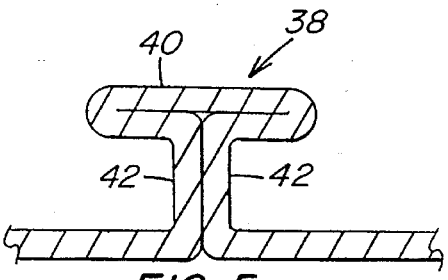
FIG. 5 is a view taken along lines 5—5 of FIG. 4.
Figure 4:
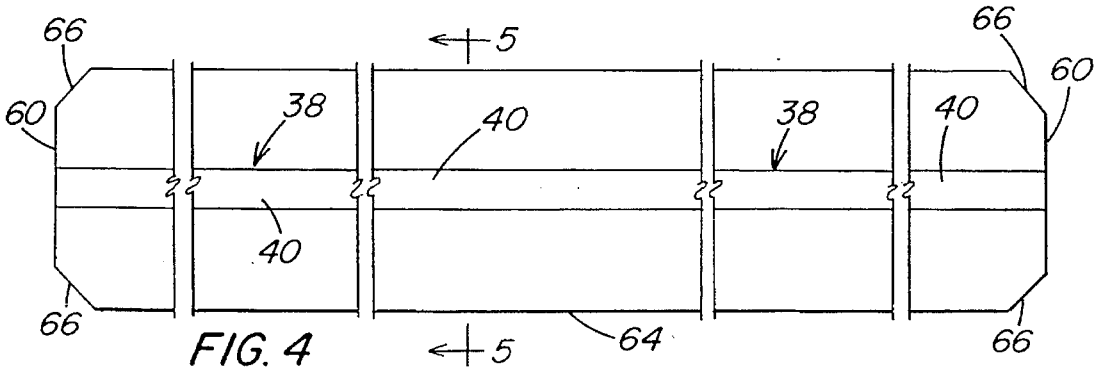
FIG. 4 is a plan view of a strip formed to have features of the invention to reduce the degree of torsional twist.

Although not limiting to the invention and with reference to FIGS. 3–5, one technique for forming the sections 62 is to provide in any usual manner a flat strip 64 e.g. a stainless steel strip having angled corners 66 so that when the spacer stock 62 shown in FIG. 3 is formed, the ends 60 are mitered. The strip 64 is formed e.g. roll formed in any usual manner to provide the strengthening member or torsional twist resistant member 38. More particularly, and with reference to FIG. 5, the strengthening member 38 is formed by bending center portions of the strip 64 toward each other and under one another to form the horizontal member 40 and thereafter toward one another to form the vertical members 42. At the bottom of the vertical members 42 as viewed in FIG. 5, the strip is preferably flat to provide the base of the spacer stock. With continued reference to FIG. 5, the height of the vertical members 42, and width of the horizontal member 40, are not limiting to the invention; however, it should be of sufficient height and width to reduce the degree of torsional twist of the spacer stock and/or spacer frame as previously discussed. After the member 38 is formed, end portions of the strip 64 on each side of the base having the member 38 are bent, formed or shaped in any convenient manner to provide the legs 30 and 32 spaced from one another (see FIG. 2) and the mitered ends 60 (see FIG. 3).

As shown in FIG. 2, although not limiting to the invention, the outer legs 30 and 32 of the spacer frame 22 are bent toward one another to provide the extensions 36 to further reduce torsional twist of the spacer section or spacer stock 62. The invention is not limited to the length of the extensions 36; however, it is recommended in the practice of the invention that the extensions 36 of the legs remain spaced from one another to eliminate a thermally conducting path. As can now be appreciated by those skilled in the art of metal forming or metal shaping, the torsional twist resistant member 38, outer legs 30 and 32, and extensions 36 of the outer legs may be formed simultaneously or in any sequence and the sequence of forming or shaping is not limiting to the invention.

Another technique for making spacer stock and/or spacer frame incorporating features of the instant invention is to shape an elongated strip to provide one section of spacer stock having sufficient length to provide a spacer frame having continuous corners. Spacer frames of this type are disclosed in the EP Application, in U.S. patent application Ser. No. 08/102,596 and in U.S. Pat. No. 5,177,916 which disclosures are hereby incorporated by reference.

In the practice of the invention it is preferred to make spacer frames having continuous corners. The invention will be discussed to make a glazing unit similar to the unit 20 shown in FIGS. 1 and 2 having a spacer frame having continuous corners. Each of the outer sheets 24 and 26 are clear glass sheets having a length of about 42⅞ inches (108.9 cm) and a width of about 19¾ inches (50.17 cm). Each of the sheets has a thickness of about 0.090 inch (0.229 cm).

One of the glass sheets 24 or 26 is coated, and the coating is of the type sold by PPG Industries under its registered trademark Sungate® 100 coated glass. The coated surface of the sheet 24 or 26 faces the compartment 28.

Figure 6:
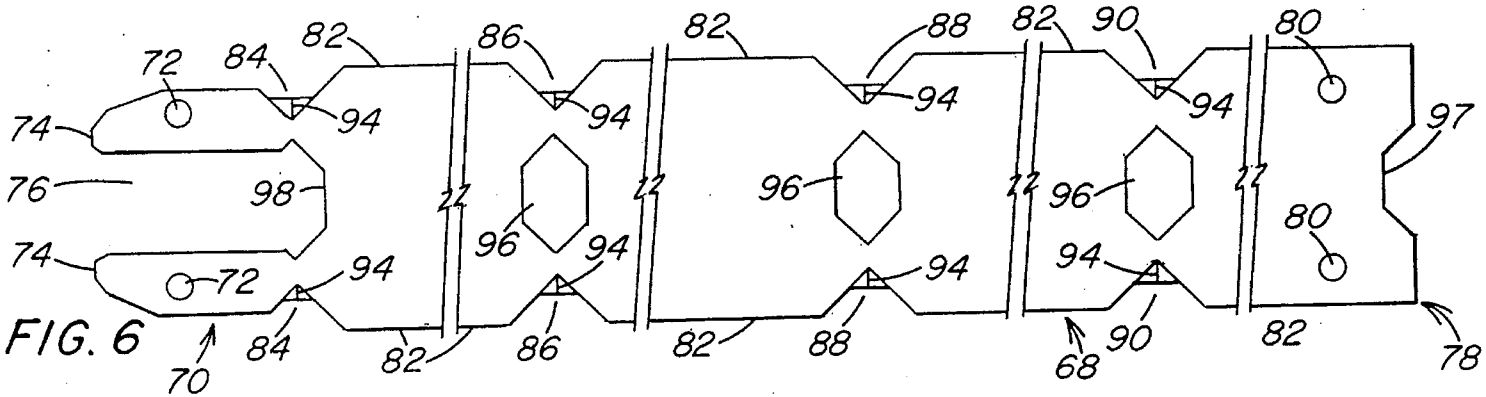
FIG. 6 is a plan view of a strip after punching and prior to forming the spacer stock to have features of the invention to reduce the degree of torsional twist.

With reference to FIGS. 6–9 as needed, a spacer frame having three continuous corners may be made as follows. A flat tin coated steel strip (not shown) having a length of about 126 inches (320 cm), a width of about 2.00 inches (5.08 cms) and thickness of about 0.010 inch (0.25 mm) is die cut to have a design similar to the one shown in FIG. 6. The die cut strip 68 has a tapered and wedged bifurcated end 70 having a pair of holes 72 in the members 74 of the bifurcated end 70. Groove 76 formed by the members 74 has a width of about 1.070 inch (2.71 cm) and a length of about 1.5 inches (3.81 cm). Opposite end 78 of the strip 68 receives the members 74 of the bifurcated end 70 and has holes 80 which are aligned with holes 72 when the closed spacer frame is formed. Spaced at locations about 1.5 inches (3.8 cm), about 21⅛ inches (53.65 cm), about 63⅞ inches (162.24 cm), and about 83½ inches (212.09 cm) from the end 70, material is removed from opposite edge portions 82 of the substrate 68 to provide sets of pair of notches 84, 86, 88 and 90 respectively. The notched areas form the bent portions 92 (see FIG. 2). Crease lines 94 are provided at the notches as shown in FIG. 6 for ease of bending the bent portions.

Each of the notches of the set of pair of notches 86, 88 and 90 have a length of about 0.536 inch (1.36 cm) at the edge 82 of the substrate, a depth of about 0.170 inch (0.43 as measured from the edge 82 of the substrate toward the center of the substrate. The notches 84 are similar in size as the notches 86, 88 and 90 but the left side of the notch as shown in FIG. 6 is further cut to insert the bifurcated members 74 of the end 70 into the end 78 after the strip 68 is formed to have a generally U-shaped cross section defined by the upright legs and the base. The distance between the points of pairs of notches depends on the width of the base i.e. the desired spacing between the outer sheets. The unit has the point of the crease lines spaced about 0.282 inch (0.71 cm) from the edge 211 of the substrate to provide the base after the strengthening member 38 is formed with a width of about 0.50 inch (2.42 cm) and a width of about 1.23 inches (3.124 cms) before the member 38 is formed. Between each of the notches 86, 88 and 90 are provided slits 96, at the end 78 of the strip 68 is cutout 97 and at the end 76 is cutout 98. The slits 96 and cutouts 97 and 98 are sized such that after the member 38 is formed, the continuous ridges at the corners are mitered as shown in FIGS. 7 and 8 at 114 to form the continuous corner of the spacer frame.

Figure 7:
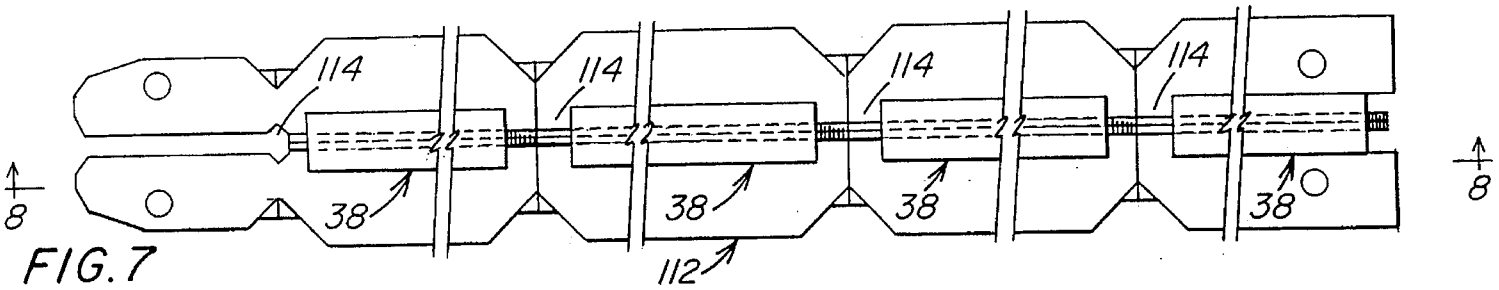
FIG. 7 is a plan view of the strip shown in FIG. 6 after forming the spacer stock to have features of the invention to reduce the degree of torsional twist.
Figure 8:
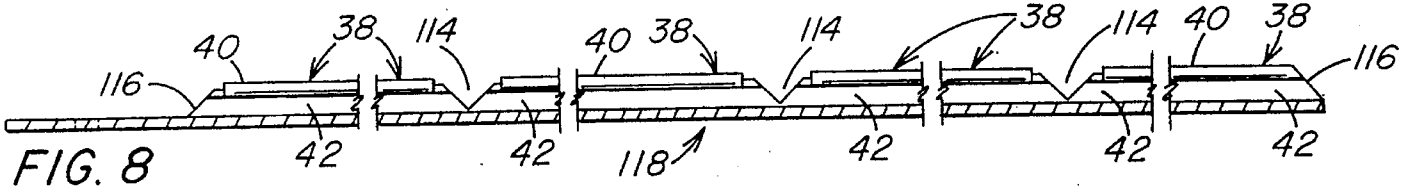
FIG. 8 is a side view of the strip shown in FIG. 7.
Figure 9:
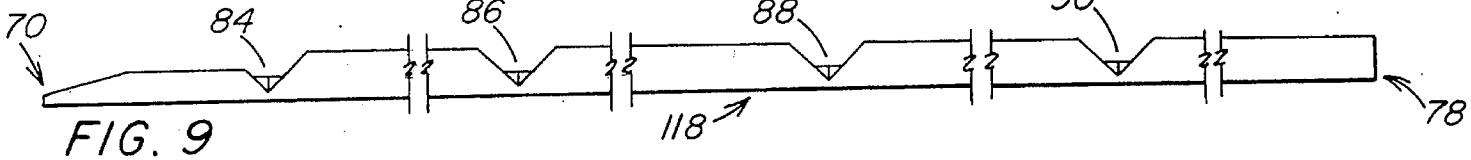
FIG. 9 is a side view similar to the view of FIG. 8 of spacer stock after outer legs of the spacer stock are formed.

After the strip is punched to provide the strip 68, the strip 68 is shaped in any convenient manner to provide a strip 112 shown in FIG. 7 having the member 38. The vertical members 42 have a length of about 0.125 inch (0.32 cm) and the horizontal member 40 has a length of about 0.250 inch (0.62 cm). With reference to FIGS. 7 and 8, the slits 96 as shown in FIG. 6 appear as V-shaped cut outs 114 and mitered ends 116 respectively in the member 38. The strip 112 is further shaped to provide spacer stock 118 (see FIG. 9) having the legs 30 and 32 which with the base 34 provide the U-shaped cross section shown in FIG. 2. Side view of the spacer stock 118 is shown in FIG. 9. After the spacer stock 118 is formed, the beads 52 having the desiccant 56 are provided by extruding in any convenient manner H. B. Fuller HL-5102-X-125 butyl hot melt matrix having the desiccant 56 therein onto the inner surface 52 of the base 34 on each side of the member 38 (see FIG. 2).

The adhesive-sealant layers 44 are extruded onto the outer surface 46 of the legs 30 and 32. The adhesive-sealant of the layers 44 may be of the type sold as H. B. Fuller 1191 hot melt butyl. The layers 44 have a thickness of about 0.020 inches (0.05 cm) and a height of about 0.300 inch (0.76 cm).

As can be appreciated, the beads 52 having the desiccant 56 may be extruded onto the base of the spacer stock before, after, or during the extrusion of the layers 44 onto the surface 46 of the legs 30 and 32, and the layers 44 may be applied to the outer surface 46 of the legs 30 and 32 during or after the strip 112 is formed into the spacer stock 118.

The spacer stock 118 is bent at the notches 88 and 90, at notch 86 and thereafter at notch 84 while the tapered members 74 of the bifurcated end 70 are telescoped into the end 78 of the spacer stock 118 to form the spacer frame having continuous corners.

The holes 72 and 80 are aligned with each and may be sealed with polyol polyisobutylene, or joined with a close end rivet or screw.

The outer glass sheets 24 and 26 are thereafter positioned over the sealant-adhesive layer 44 and biased toward one another to flow the sealant-adhesive layer 44 to secure the outer glass sheets to the legs 30 and 32 of the spacer frame. Thereafter the sealant-adhesive 48 is flowed into the channel formed by the marginal edge portions of the sheets and the base 34 of the spacer frame.

As can be appreciated, the invention is not limited to the above embodiments of the invention which were presented for illustrative purposes and not to limit the invention.

Figure 10:
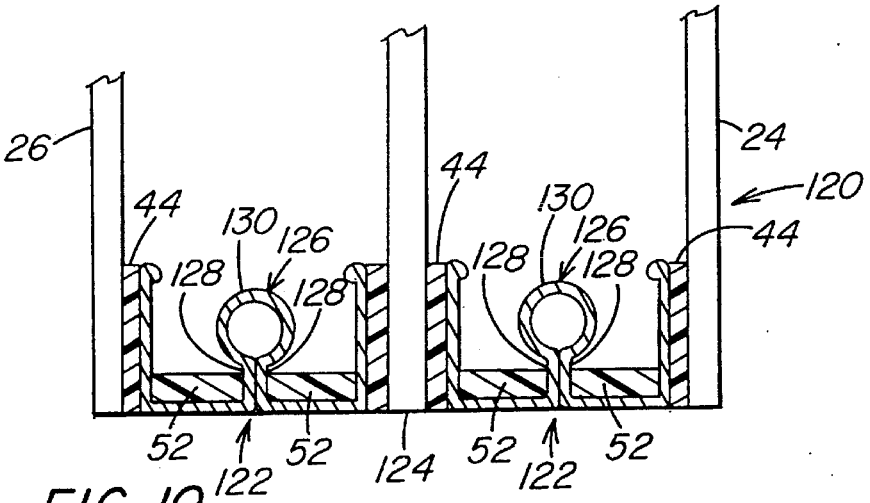
FIG. 10 is a view similar to the view of FIG. 2 showing a triple sheet glazed unit having the sheets separated by a spacer frame incorporating features of the invention.

With reference to FIG. 10, there is shown a triple glazed unit 120 having outer glass sheets 24 and 26 and spacer frames 122 incorporating feature of the invention. One of the spacer frames 122 is between and secured to the outer sheet 26 and intermediate sheet 124, and the other one of the spacer frames 122 is between and secured to the outer sheet 24 and the intermediate sheet 124; in each instance by the layers 44 of sealant. Torsional twist resistant member 126 incorporating features of the invention and similar to the member 38 shown in FIG. 2 to reduce the degree of rotational twist, has a vertical leg 128 having a circular end 130.

Figure 11:
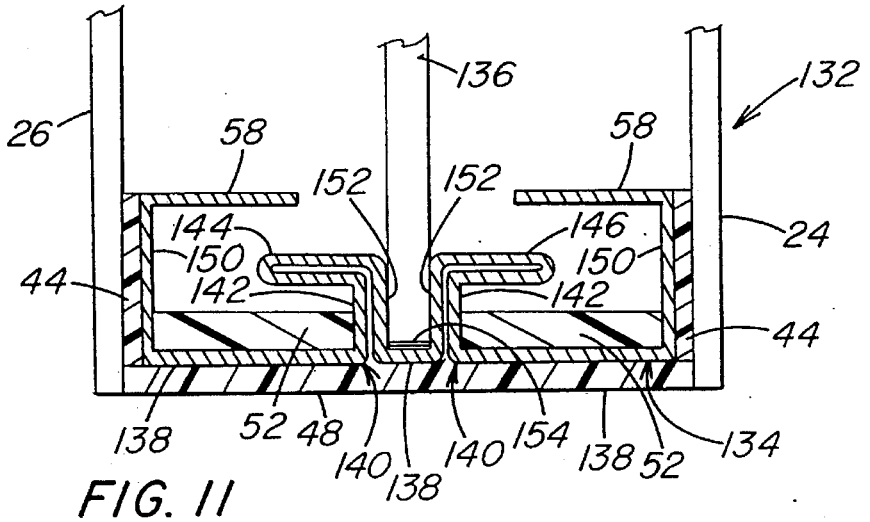
FIG. 11 is a view similar to the view of FIG. 2 showing another embodiment of a triple glazed unit constructed having a spacer frame incorporating features of the invention.

Referring now to FIG. 11 triple glazed unit 132 includes the outer sheets 24 and 26 separated by and joined to spacer frame 134 by the sealant layers 44. An intermediate sheet 136 is supported on base 138 of the spacer frame 134. Torsional twist resistant member 140 incorporating features of the invention no reduce the degree of rotational twist includes vertical members 142 and 143, and horizontal members 144 and 146, with the horizontal member 144 extending to the left and the horizontal member 146 extending to the right as viewed in FIG. 11. The extensions 58 of outer legs 150 of the spacer frame 134 extend further than the extensions 36 of the legs 30 and 32 of the spacer frame 22 shown in FIG. 2. The vertical members 142 and 143 of the strengthening member 140 form a groove 152 to receive marginal edges of the intermediate sheet 136 as shown in FIG. 11. It is recommended that a resilient material 154 be provided in the groove 152 prevent edge damage to the intermediate sheet 136.

Figure 12:
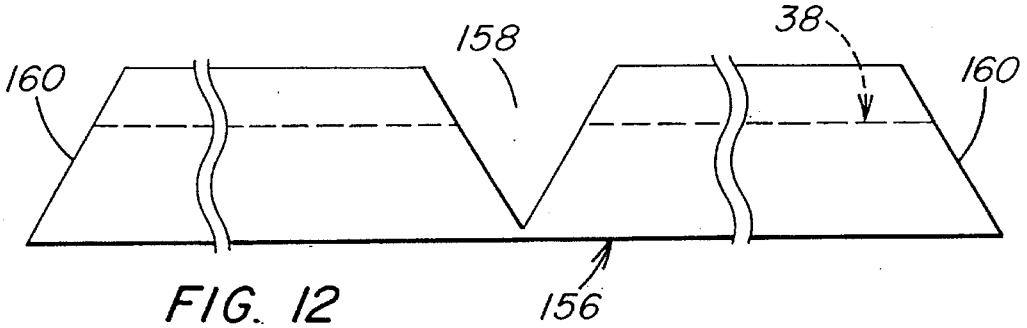
FIG. 12 is a fragmented plan view of another embodiment of spacer stock incorporating features of the invention.

In FIG. 12 there is shown spacer stock 156 having the strengthening member 38 shown in phantom. The spacer stock 156 has a "V" shaped cut out 158 in each of legs 160 (only one shown in FIG. 11). When the spacer stock 156 is bent to form a spacer frame, the legs 160 are bent toward one another to form the corner closing the "V". The base (not shown) of the spacer stock 160 is continuous as discussed for the spacer stock formed from strip 118 (see FIG. 9) providing a spacer frame with a continuous corner.

Figure 13:
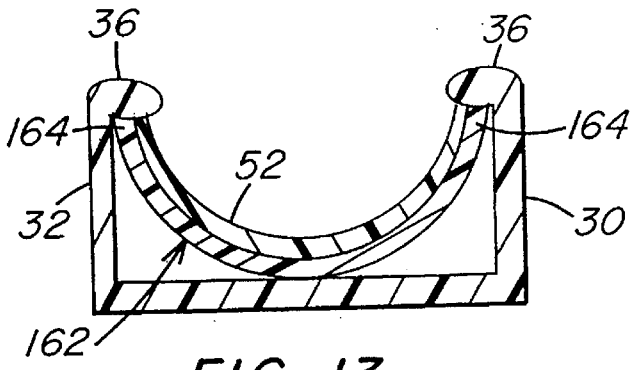
FIGS. 13–16 are cross sectional views of spacer stock and/or spacer frame illustrating various designs of inserts incorporating features of the invention to reduce or eliminate torsional twist of the spacer stock and/or spacer frame.
Figure 14:
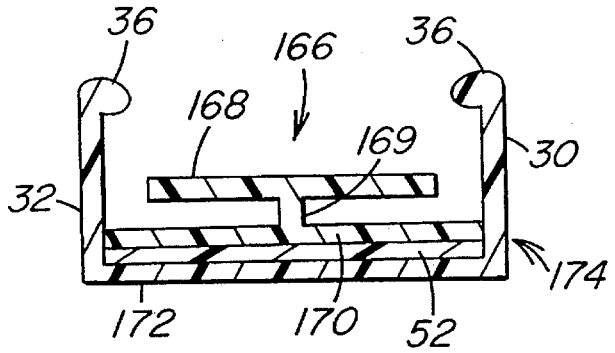
Figure 15:
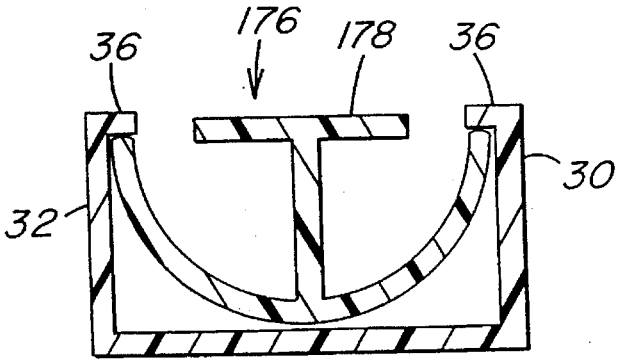
Figure 16:
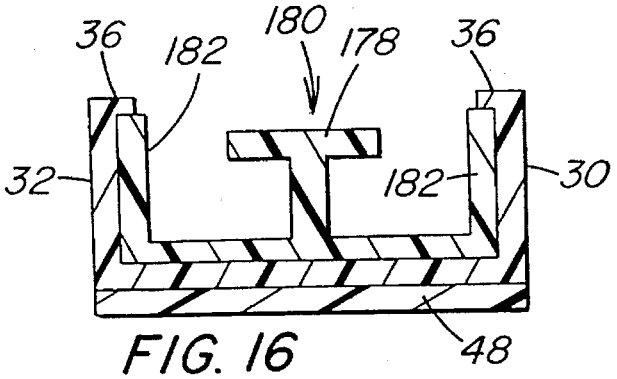

As can be appreciated, the invention is not limited to forming the strengthening member or torsional twist resistance member from the strip forming the spacer stock/spacer frame. For example and with reference to FIGS. 13–16 there is shown various inserts to eliminate or reduce the torsional twist that may be positioned between the upright 30 and 32 of the spacer stock used. With specific reference to FIG. 13 strengthening member 162 for reducing the degree of torsional twist has a semicircle cross section with ends 164 of the member 162 engaging the extensions 36 or 58 (see FIG. 11) of the spacer stock. A bead 52 having the desiccant 56 is provided on the surface of the member 162 facing the compartment 28 (see FIG. 2). In FIG. 14, strengthening member 166 is similar in design to the member 38 of FIGS. 2 and 5. More particularly, the member 166 has formed by horizontal member 168, vertical member 169 an "I" cross section and base 170. The base 170 is secured to inner surface of base 172 of the spacer stock 174 by the bead 52 having the desiccant 56 (see FIG. 2). In FIG. 15, strengthening member 176 is similar to the member 162 except the member 176 has raised portion 178 similar to the strengthening member 166 shown in FIG. 14. In FIG. 16, member 180 is similar to the member 166 shown in FIG. 14 except it has upright legs 182 that engage the extensions 36.

The strengthening members 162, 166, 176 and 180 incorporating features of the invention to eliminate or reduce torsional twist may be made of any material e.g. plastic, wood, pressed paper, cardboard or metal. The advantage of using inserts instead of forming the torsional resist member from a substrate forming the spacer stock is that it reduces cost of changing the process or equipment. The strengthening members 162, 166, 176 and 180 may be any length e.g. extend between adjacent corners of the spacer frame, or be in sections between corners of the spacer frame. The moisture pervious adhesive 52 having the desiccant 56 (see FIG. 2) may be used to aid in securing the members 162, 166, 176 and 180 in place. When the members extend between adjacent corners of the spacer frame and the adhesive 52 is under the members, holes may be provided in the strengthening members to provide communication between the compartment 28 and the desiccant 56 in the adhesive 52 (see FIG. 2).

Figure 17:
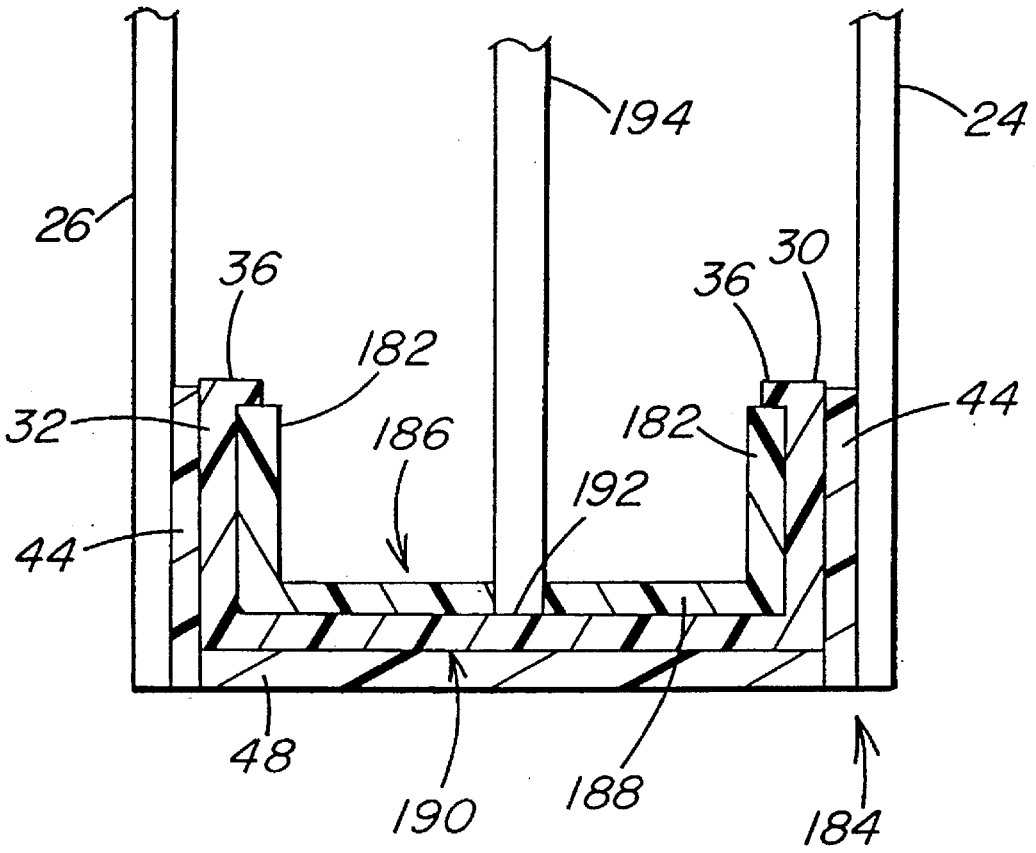
FIG. 17 is a view similar to the views of FIG. 2 showing another embodiment of triple glazed unit having an insert of the instant invention to secure the intermediate sheet in position and to reduce or eliminate torsional twist.

As can be appreciated, the invention is not limited to using insert members for making insulating units having two outer sheets. For example and not limiting to the invention, shown in FIG. 17 is a triple glazed unit 184 having insert strengthening member 186 for reducing the torsional twist secured between the legs 30 and 32 of spacer frame 190 by the bead 52. The strengthening member 186 is similar in cross section to the strengthening member 180 except in place of the member 178 having the T shape cross section it has a groove 192 for receiving marginal edge portion of intermediate sheet 194 as shown in FIG. 17. The member 186 is flat and does not reduce the degree of rotational twist as much as the other members 162, 166, 176 and 180 shown in FIGS. 13–16; however, if a higher reduction of torsional twist is desired, a groove may be provided in the members 162, 166, 176 and 180 to receive marginal edge of the intermediate sheet in a similar manner as the groove 162 is provided as shown in FIG. 11.

As can now be appreciated, the embodiments of the invention present are for purposes of illustration only and are not limiting to the invention and other embodiments are contemplated by the invention.

What is claimed is:

1. A spacer stock comprising:

an elongated member having a pair of outer legs defined as a first leg and a second leg, the first and second legs interconnected by a base, the first and second legs and the base providing a generally U-shaped cross section with the first and second legs spaced from one another and only contacting one another by way of the base, and a strengthening member integrally formed with the base, extending away from the base, and spaced from and out of contact with the first and second legs.

2. The spacer stock of claim 1 wherein the strengthening member includes a vertical member and a horizontal member.

3. The spacer stock of claim 2 wherein the strengthening member has a "T" shape cross section including the vertical member extending between and spaced from the first and second legs and away from the base, and the horizontal member.

4. The spacer stock of claim 3 wherein the spacer stock is made of metal and the strengthening member reduces twist to less than 0.23 radians per inch.

5. The spacer stock of claim 2 wherein the horizontal member has radiused portions.

6. The spacer stock of claim 1 wherein the strengthening member has a "T" shape cross section including a vertical member extending between and spaced from the first and second legs and away from the base, and a horizontal member.

7. The spacer stock of claim 6 wherein the strengthening member reduces twist to less than 0.15 radians per inch.

8. A spacer stock comprising:

an elongated member having first and second outer legs interconnected by a base, the first and second outer legs and the base providing a generally U-shaped cross section, and a strengthening member to reduce the degree of torsional twist of the elongated member, the strengthening member integrally formed with the base and having a pair of vertical extensions extending away from the base between and spaced from the outer legs and spaced from one another to provide a groove therebetween.

9. The spacer stock of claim 8 wherein a horizontal extension is connected to each of the vertical extensions, each of the horizontal extensions are spaced from the base and extend toward adjacent one of the outer legs.

10. The spacer stock of claim 9 wherein each of the pair of vertical extensions includes a pair of vertical members and each of the horizontal extensions include a pair of horizontal members.

11. The spacer stock of claim 8 wherein each of the vertical extensions has an end spaced from the base and the end of each vertical extension is radiused.

12. A spacer stock comprising:

an elongated member having first and second outer legs interconnected by a base, the first and second outer legs and the base providing a generally U-shaped cross section, and a strengthening member to reduce the degree of torsional twist wherein the strengthening member has a base that mounts the base of the elongated member between the legs and engages the legs and an upright member connected to and extending away from the base of the strengthening member.

13. The spacer stock of claim 12 wherein the upright member connected to the base of the strengthening member has a groove.

14. A closed ended spacer frame for separating sheets of an insulating unit comprising:

a first outer leg spaced from a second outer leg and connected by a base to provide the spacer frame with a "U" shaped cross section with ends of the first and second legs spaced from and out of contact with one another, and a strengthening member integrally formed with the base, the member having a vertical member and a horizontal member.

15. A multiple sheet glazed unit comprising:

a pair of glass sheets;

a spacer frame having outer legs joined by a base between the pair of glass sheets, the spacer frame having a strengthening member to reduce the degree of torsional bend, wherein the strengthening member is integrally formed with the base and has a vertical member extending between the upright legs away from the base and a horizontal member, and a sealant adhering the sheets to adjacent ones of the outer legs.

16. The multiple sheet glazing unit as set forth in claim 13 wherein the strengthening member has a "T" shape cross section including the vertical member and the horizontal member.

17. The unit of claim 16 wherein the spacer frame is made of metal and the strengthening member reduces twist to less than 0.23 radians per inch.

18. The unit of claim 17 wherein the strengthening member reduces twist to less than 0.15 radians per inch.

19. The multiple sheet glazing unit as set forth in claim 13 wherein the horizontal member has radiused portions.

20. A multiple sheet glazing unit comprising:

a pair of glass sheets;

a spacer frame having outer legs joined by a base between the sheets, the spacer frame having a strengthening member to reduce the degree of torsional bend integrally formed with the base and between the outer legs, the strengthening member including a pair of vertical members spaced from one another to provide a groove therebetween a horizontal member mounted on one of the vertical members extending toward adjacent leg of the spacer frame and a horizontal member mounted on the other one of the vertical members and extending toward adjacent leg of the spacer frame;

a sealant adhering the sheets to adjacent ones of the outer legs, and a glass sheet between the outer sheets in the groove of the strengthening member.

21. The multiple sheet glazing unit as set forth in claim 20 wherein the strengthening member has a "T" shaped cross section.

22. A multiple sheet glazing unit comprising:

a pair of glass sheets;

a spacer frame having outer legs joined by a base between the sheets;

the spacer frame having a strengthening member to reduce the degree of torsional bend mounted on the base between the outer legs, wherein the strengthening member is an insert including a base integrally formed with a member having a "T" shape cross section, the "T" shape cross member including a vertical member extending between and spaced from the outer legs and away from the base of the insert and a horizontal member, with the base of the insert engaging the outer legs of the spacer frame to secure the base of the insert therebetween, and a sealant adhering the sheets to adjacent ones of the outer legs.

23. The multiple sheet glazing unit as set forth in claim 22 wherein the "T" shaded cross member has a groove to receive marginal edges of an intermediate sheet.

* * * * *

UNITED STATES PATENT AND TRADEMARK OFFICE

CERTIFICATE OF CORRECTION

PATENT NO. : 5,617,699

DATED : April 8, 1997

INVENTOR(S) : Albert E. Thompson, Jr.

It is certified that error appears in the above-indentified patent and that said Letters Patent is hereby corrected as shown below:

Claim 15, line 9, delete "upright" and insert --outer--.

Claim 23, line 2, delete "shaded" and insert --shaped--.

Signed and Sealed this

Fourteenth Day of October, 1997

*Attest:*

*Attesting Officer*

BRUCE LEHMAN

*Commissioner of Patents and Trademarks*